US005549069A

United States Patent [19]

Faidi

[11] Patent Number: 5,549,069

[45] Date of Patent: Aug. 27, 1996

[54] ENCLOSURE FOR SHIELDING MOORED WATER VESSEL HULL FROM DIRECT CONTACT WITH WATER

[76] Inventor: Zayd Faidi, 535 Larkspur Plaza Dr., Apt. No. 10, Larkspur, Calif. 94939

[21] Appl. No.: 165,811

[22] Filed: Dec. 10, 1993

[51] Int. Cl.[6] ..... B63B 59/08

[52] U.S. Cl. ..... 114/222; 114/230

[58] Field of Search ..... 114/222, 230

[56] References Cited

U.S. PATENT DOCUMENTS

| | | | |
|---|---|---|---|
| 1,973,813 | 9/1934 | Kelley | 114/222 |
| 3,142,283 | 7/1964 | Fisher | 114/222 |
| 3,685,477 | 8/1972 | Wood | 114/222 |
| 4,215,644 | 8/1980 | Jackson | 114/230 X |
| 4,280,436 | 7/1981 | Jackson | 114/222 |
| 4,280,437 | 7/1981 | Jackson | 114/222 |
| 4,280,438 | 7/1981 | Jackson | 114/222 |
| 4,280,439 | 7/1981 | Jackson | 114/222 |
| 4,282,822 | 8/1981 | Jackson | 114/222 |
| 4,693,200 | 9/1987 | Noble | 114/222 X |
| 5,138,963 | 8/1992 | Eichert | 114/222 |
| 5,152,242 | 10/1992 | Bradley | 114/222 |
| 5,279,244 | 1/1994 | Perez-Collazo | 114/230 X |

FOREIGN PATENT DOCUMENTS

| | | | |
|---|---|---|---|
| 0360436 | 3/1990 | European Pat. Off. | 114/222 |

*Primary Examiner*—Sherman Basinger
*Attorney, Agent, or Firm*—David Pressman

[57] ABSTRACT

Apparatus for shielding the submerged portion of a moored water vessel, such as a boat hull and driving gear, from direct contact with water. The apparatus protects the hull and driving gear from marine growth, electrolysis, water deterioration of underwater hull fittings and driving gear, fiberglass hull blistering, wood rot, and water leakage. The preferred form of the assembly includes a rigid frame which is secured to support brackets which are attached to a boat dock. This frame is larger than the perimeter of the water vessel hull above the water line. The rear of the frame includes a gate which is attached to the front portion of the frame by horizontal lag bolts. Attached to and dangling below the frame and gate is a water-impervious bag which is larger than the underwater portion of the water vessel. Gate lines which extend from the gate to cleats on the boat dock are lowered, thus lowering the gate to allow the water vessel to enter the bag. Then the gate lines are raised, thus raising the gate above the water line so that the hull is enveloped by the bag below the waterline. The bottom of the bag contains a low area containing an electric water pump with a water evacuation hose running to the outside of the apparatus. When the water pump is turned on, it will pump out the water which is inside the bag, leaving the boat hull floating, but shielded from direct contact with water. The vessel exits the enclosure by lowering the gate lines which lower the gate.

62 Claims, 9 Drawing Sheets

ENCLOSURE FOR SHIELDING MOORED WATER VESSEL HULL FROM DIRECT CONTACT WITH WATER

BACKGROUND—FIELD OF INVENTION

This invention relates generally to shielding of boats, specifically to the submerged portion of a moored water vessel hull and driving gear from direct contact with water.

BACKGROUND—DESCRIPTION OF PRIOR ART

When a water vessel, such as a boat, is left moored in a body of water for a period of time, the hull of the vessel, as well as the submerged portions of the driving gear of the vessel, will be susceptible to various undesirable effects, including marine growth such as algae and barnacles. This marine growth may cause damage to the hull, and will adversely affect the performance of the vessel while underway because it adds weight and causes drag on the hull. The marine growth can also block the vessel's engine water-cooling intake ports. Other undesirable effects that a water vessel can experience if left in a body of water for a period of time include deterioration of underwater hull fittings and driving gear, electrolysis, water leakage, fiberglass hull blistering, and hull rot in the case of a wooden hull.

Various methods of protecting a boat hull from some of the above-mentioned damaging effects have been developed. Examples of these devices are shown in the following patents: U.S. Pat. No. 1,973,813, issued Sep. 18, 1934 to Kelly. U.S. Pat. No. 3,142,283, issued Jul. 28, 1964 to Fisher. U.S. Pat. No. 3,685,477, issued Aug. 22, 1972 to Wood. U.S. Pat. No. 4,215,644, issued Aug. 5, 1980 to Jackson. U.S. Pat. No. 4,280,436, issued Jul. 28, 1981 to Jackson. U.S. Pat. No. 4,280,437, issued Jul. 28, 1981 to Jackson. U.S. Pat. No. 4,280,438, issued Jul. 28, 1981 to Jackson. U.S. Pat. No. 4,280,439, issued Jul. 28, 1981 to Jackson. U.S. Pat. No. 4,282,822, issued Aug. 11, 1981 to Jackson. U.S. Pat. No. 4,693,200 issued Sep. 15, 1987 to Noble. U.S. Pat. No. 5,152,242 issued Oct. 6, 1992 to Bradley.

Kelly shows a complex apparatus and method of surrounding a ship with a flexible envelope using a barge which helps position the envelope under the ship. Then air is injected into inflatable pockets around the perimeter of the envelope. Kelly suggests pumping most of the water trapped inside the envelope into tanks onboard the barge or into the sea. The water onboard the barge is chemically treated and then pumped back into the envelope. After a period of time, most of the chemically treated water in the envelope is pumped back into the tanks on board the barge. This water in the barge is then treated with more chemicals to reduce or eliminate its toxicity before it is discharged into the sea again. This device is relatively complex, difficult to install, difficult to maintain, difficult to operate, not practical, and expensive to produce. His device does not protect the boat hull from fiberglass hull blistering, hull rot in the case of a wooden hull, water leakage, water deterioration of underwater boat hull fittings, nor driving gear because it allows water to be trapped adjacent the boat hull during the entire period that the boat is moored.

Fisher shows a sheath that is slipped around the lower portion of the hull and secured via elastic members to the deck of the boat. Fresh water is then introduced into the bag via a hose. As salt water is denser than fresh water, the salt water will sink to the bottom of the bag where it will exit the bag via a one-way check valve. The remaining salt water in the bag will become diluted and thus discourage the formation of marine growth. In cases where fresh water is not available, Fisher suggests adding a chemical inhibitor to the water inside the bag. This device is very difficult to install on the boat, wastes water, and will not prevent formation of fresh water marine growth on the hull. If the chemical inhibitor is used, the chemically treated water will spill and pollute the main body of water when the enclosure is removed.

Wood shows a relatively complex rigid framework which extends from above the water line to a depth beyond the draft of the hull which it shields. A bag which must always contain water surrounds the exterior of the frame. A portion of the frame which is above the water line is lowered to allow the boat to move inside or out of the framework. Once the boat enters the framework, the lowered portion of the framework is raised so that the frame completely surrounds the boat above the waterline. A chemical which can kill marine growth is then introduced to the water trapped inside the bag. The frame of Wood's device is relatively complex, difficult to install, and expensive to produce. This device does not protect the boat hull from fiberglass hull blistering, rot in the case of a wooden hull, water leakage, water deterioration of underwater boat hull fittings, nor driving gear because it allows water to be trapped adjacent the boat hull during the entire period that the boat is moored. Additionally, the toxic chemical used to kill the marine growth inside the bag will spill into and pollute the main body of water when the frame is opened to allow the boat to exit from the enclosure.

The Jackson patents show an inflatable toroidal bladder to which a water impervious shroud is secured. A gas pump is used to selectively inflate or deflate the bladder, causing it to be deployed around the boat hull or to be submerged to allow the boat to enter and exit the apparatus. When the boat is inside the apparatus, the water inside the shroud is pumped out. The apparatus is guided when rising and submerging by guide members mounted to the sea bed floor. These devices are complex, difficult to install, difficult to operate, difficult to maintain, expensive to produce and will not work in a deep water mooring since they rely on guide members mounted on the sea bed floor.

Noble shows a hollow rectangular shaped frame to which an envelope large enough to enclose a boat hull is attached. The front section of the frame is filled with floatation materials which maintain the front section above the water line. The interior of the side and rear frame sections can be selectively filled with water or the water can be evacuated from the frame sections and replaced by air. This causes the frame sections to submerge below the water line to allow the boat to enter the apparatus and rise above the waterline so as to surround the boat. The water trapped inside the envelope is then treated with a chemical to kill and prevent further marine growth from forming on the hull. This apparatus is complex, difficult to install, difficult to maintain, relatively expensive to produce, and will pollute the main body of water when the frame is submerged to allow the boat to exit from the apparatus because the chemically treated water inside the envelope will spill into the main body of water. Additionally, Noble's device does not protect the boat hull from fiberglass hull blistering, rot in the case of a wooden hull, water leakage, water deterioration of underwater boat hull fittings nor driving gear because it allows water to be trapped between the boat hull and envelope during the entire period that the hull is moored.

Bradley shows an opaque shroud attached to a flotation collar. The interior of the flotation collar can be selectively flooded with water or the water can be removed, thus allowing the frame to be selectively submerged to allow the boat to enter the apparatus or be deployed around the vessel above the water line. The upper peripheral portion of the shroud has a continuous flap which abuts the perimeter of the boat hull and prevents sunlight from entering the bag, thus preventing marine organisms from growing on the boat hull while the boat is inside the bag. This device is relatively complex, difficult to maintain, and expensive to produce. Additionally, Bradley's device does not protect the hull from fiberglass hull blistering, rot in the case of a wooden hull, water leakage, water deterioration of underwater hull fittings, nor driving gear because it allows water to be trapped adjacent the boat hull during the entire period that the boat is moored.

OBJECTS AND ADVANTAGES

Accordingly, several objects and advantages of my invention are to provide a method and assembly for protecting a moored boat's hull that is relatively inexpensive, simple to install, simple to operate, environmentally safe, not water wasteful, reliable, adaptable to various types of water vessel hulls, and can operate in deep water moorings.

Other objects and advantages are to provide such a method and assembly which will protect the below-the-water-line portion of a hull and the driving gear of a water vessel from the damaging effects that these areas can experience if left in the water for a period of time. These include significantly reducing marine growth on the hull and driving gear, protecting the vessel against electrolysis, water leakage, water deterioration of the vessel's underwater hull fittings and submerged portions of the driving gear, fiberglass hull blistering and rot in the case of a wooden hull.

Another object and advantage is to protect a water vessel hull which sits, during low tide, on the sea bed from scratches and dirt caused by debris on the sea bed, as well as prevent mud, silt or sand from entering the vessel's water intake ports while the water vessel sits on the seabed.

Further objects and advantages will become apparent from a consideration of the drawings and the following description.

Figure 1:
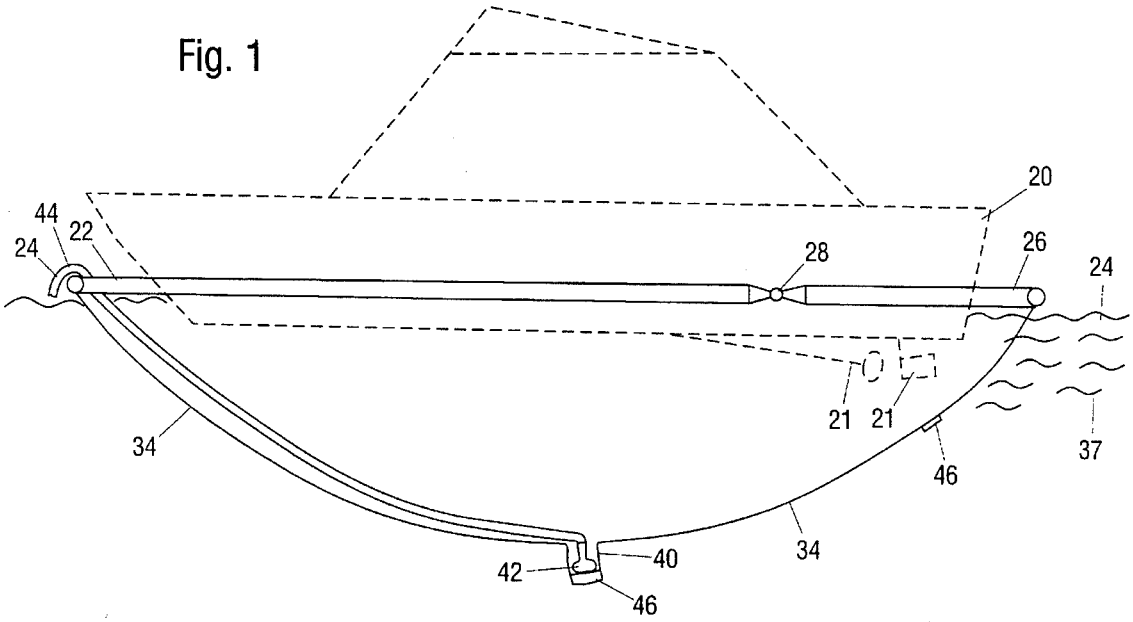
FIG. 1 is a side view of a preferred form of a boat hull enclosure in accordance with the invention.

| Reference Numerals | |
|---|---|
| 20 Hull | 36 Upper peripheral portion of bag |
| 21 Driving gear | 37 Main body of water |
| 22 Frame | 38 Ribs in bag |
| 23 Frame support brackets | 39 Manual gear crank system for raising and lowering the gate |
| 24 Waterline | 40 Low area in bag preferably formed of rigid material creating a rigid water well |
| 25 Clasp | 41 Perforated water suction hose |
| 26 Gate | 42 Water pump |
| 28 Horizontal lag bolts serving as pivot pins | 43 Sleeve |
| 30 Gate line | 44 Water evacuation hose |
| 31 Electric gate motor | 66 Lines |
| 32 Dock | 68 Inflatable tube acting as a frame |
| 33 Swinging gate support arm | 70 Frame containing buoyancy means and floats directly on water |
| 34 Water impervious bag | 90 Lines connecting bag to dock |
| 35 Hinge bracket | 92 Protrusions on inside of bag |
| 45 Water pump | |
| 46 Ballast weight | |
| 48 Hinge bracket | |
| 56 Flotation device/air filled plastic container | |
| 60 Inflatable tube sections used to raise and lower the gate | |
| 62 Air line | |
| 64 Air pump | |

SUMMARY

The present invention is an enclosure for shielding a moored water vessel hull from direct contact with water, thus protecting the hull and driving gear from marine growth, electrolysis, water deterioration of underwater hull fittings and driving gear, possible fiberglass hull blistering, possible rot in the case of a wooden hull, and water leakage. The preferred form of the assembly includes a rigid frame which is secured to support brackets which are attached to a boat dock. This frame is larger than the perimeter of the hull above the water line. The rear of the frame includes a gate which is attached to the front portion of the frame by horizontal lag bolts. Attached to and dangling below the frame and gate is a water impervious bag which is larger than the underwater portion of the water vessel. Gate lines which extend from the gate to cleats on the boat dock are lowered, thus lowering the gate to allow the water vessel to enter the bag. Then the gate lines are raised, thus raising the gate above the waterline so that the hull is enveloped by the bag below the waterline. The bottom of the bag contains a low area containing an electric water pump with a water evacuation hose running to the outside of the apparatus. When the pump is turned on, it will pump out the water which is inside the bag, leaving the boat hull floating, but shielded from direct contact with water. The vessel exits the enclosure by lowering the gate lines which lower the gate.

Description of Hull Enclosure—FIGS. 1, 2, 3, 5, 6, 7, and 8

FIG. 1 is a side view of a boat to be protected having a hull 20 and driving gear 21. The boat is moored in water which has a water line 24. Hull 20 is surrounded by an enclosure in accordance with the invention. The enclosure comprises a rigid frame 22 which is greater in size than hull 20 above water line 24. Frame 22 may be fabricated of rigid metal, rigid plastic, or another appropriate material. Frame 22 can be made in one piece, but preferably is assembled from smaller interconnected sectional pieces that are attached by suitable means, preferably snapped into one another.

Frame 22 is secured to a floating object, such as dock 32 (FIG. 3), by suitable means, such as frame support brackets 23 which are attached on one end to frame 22 and on the other end to dock 32 by suitable means, such as bolts. The rear end of frame 22 includes a gate 26. Gate 26 is attached to the front portion of frame 22 by horizontal lag bolts 28 that serve as pivot pins. Gate 26 is moveable between its raised, closed position, shown in FIG. 1, and a lowered, open position, shown in FIG. 2, by suitable means, such as one or more gate lines 30 (FIG. 3) secured on one end to gate 26 and on the other end to cleats (not shown), which are secured to dock 32 or the boat.

Figure 5:
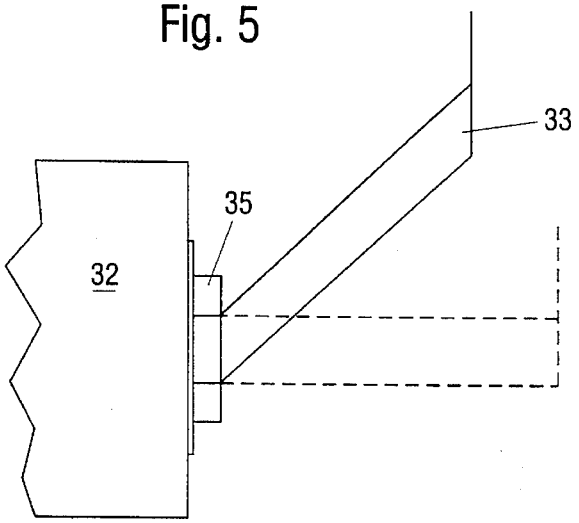
FIG. 5 is a side view of a preferred form of a boat dock mounted gate support arm used with the enclosure.
Figure 6:
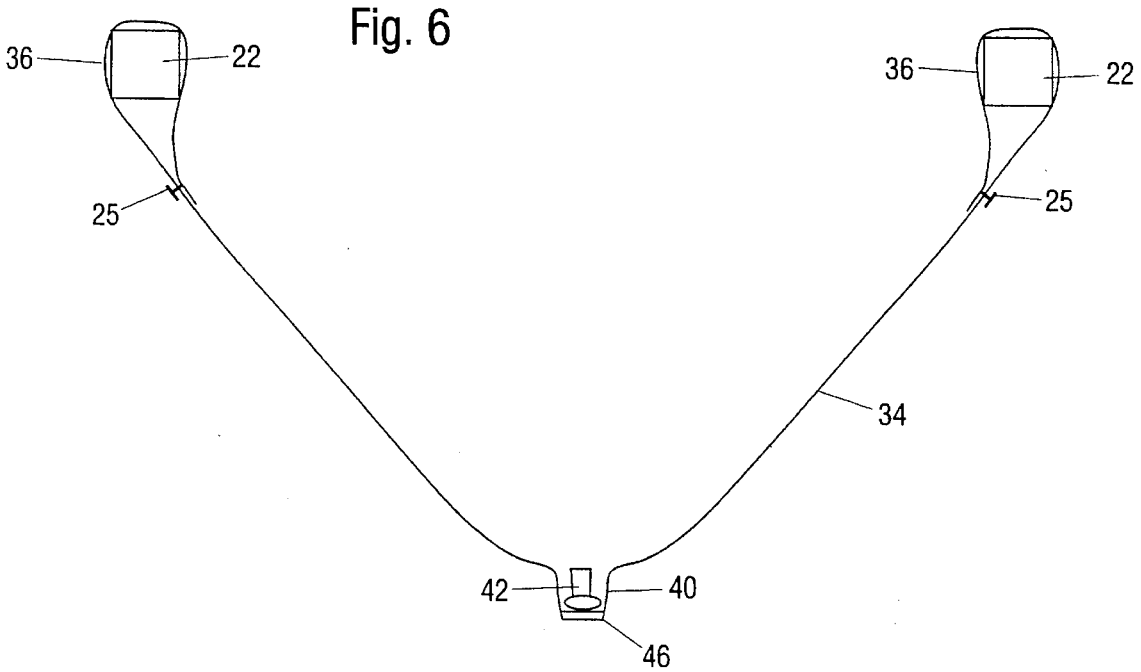
FIG. 6 is a cross-sectional view of the preferred form of attaching the bag to the frame.

When it is in the raised position, gate 26 is also supported by one or more pivotally swinging gate support arms 33 (FIGS. 3 and 5) attached by hinge bracket 35 to dock 32 (FIG. 5).

A bag 34 (FIG. 1) made of a water-impervious material, such as plastic, is removably secured to frame 22 and gate 26 by suitable means. Namely, the entire upper peripheral portion 36 (FIG. 6) of bag 34 is wrapped around frame 22 and gate 26 and is clasped to itself utilizing a conventional type of clasp 25.

Figure 7:
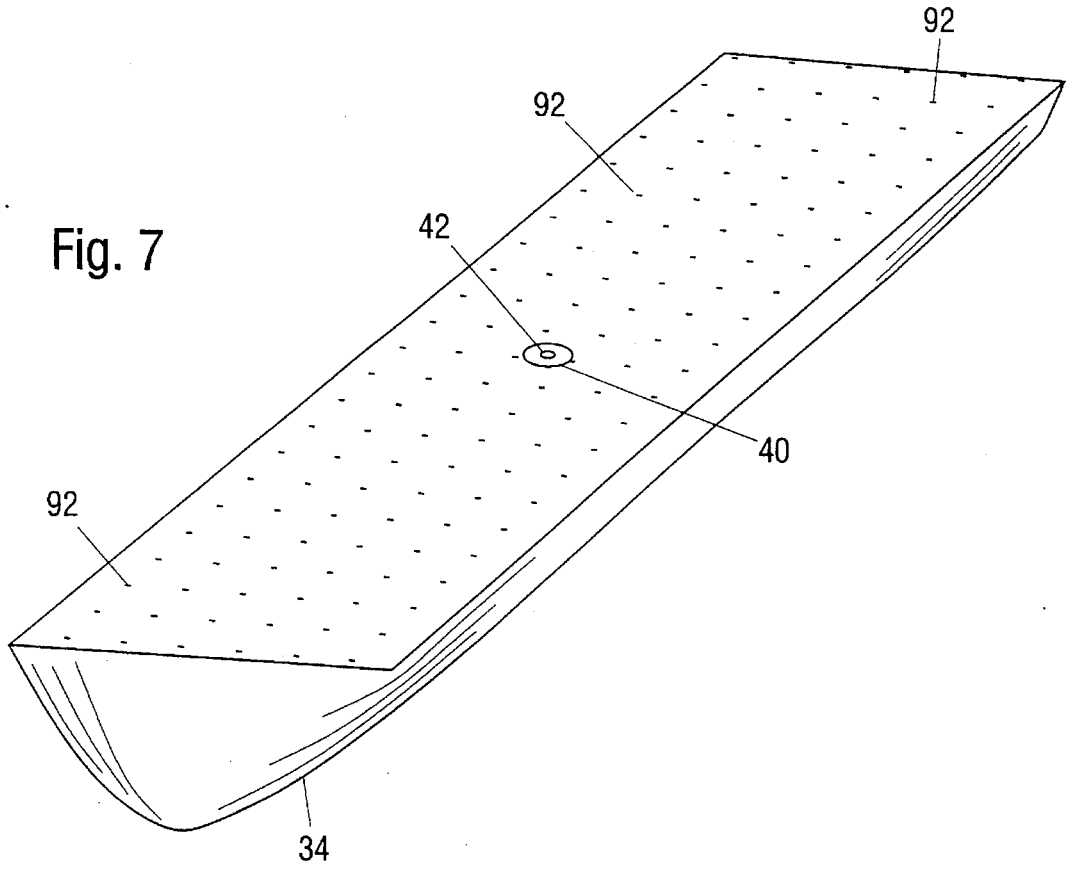
FIG. 7 is a view of a bag with protrusions on the inside surface of the bag.
Figure 8:
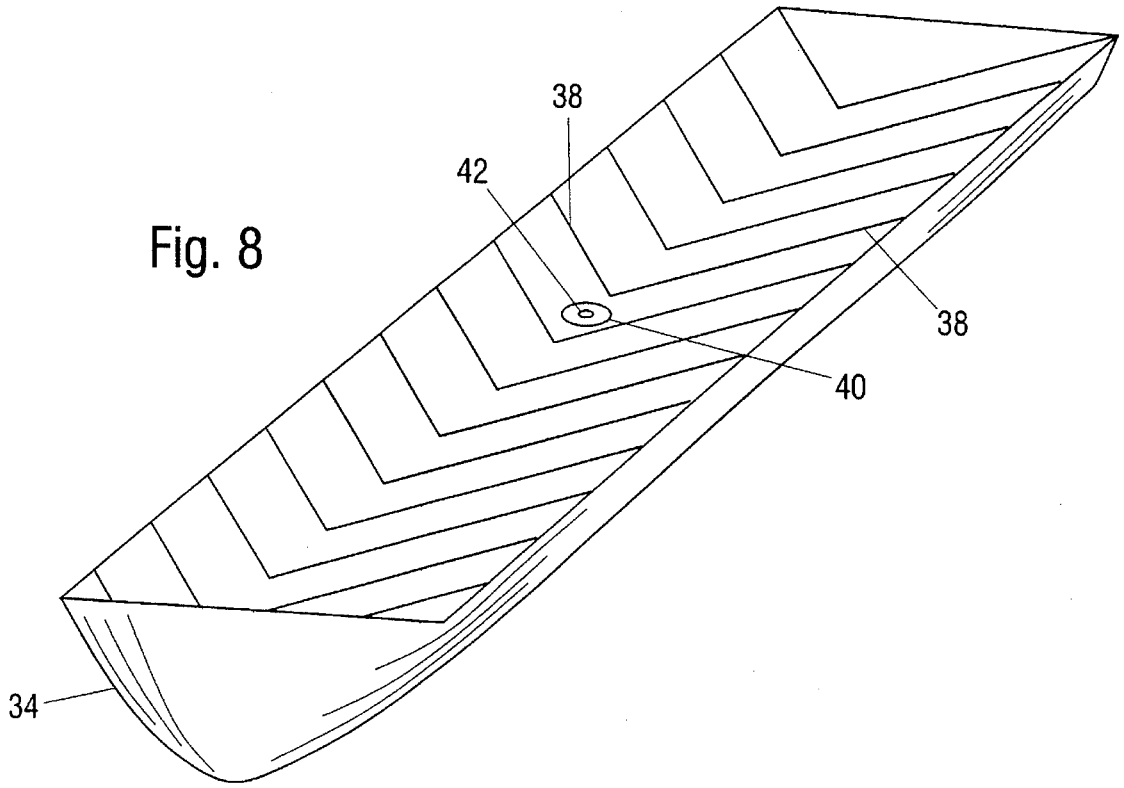
FIG. 8 is a view of a bag utilizing an interior "rib" design forming an alternative shape.

The inside surface of bag 34 can be smooth, but preferably has numerous protrusions 92, as shown in FIG. 7, which act as water channels. These protrusions can be formed in various ways, such as by molding and imbedding small pieces of plastic into the inner skin of the bag. Alternatively bag 34 can have longer sections of solid material sandwiched intermittently in between outside and inside skins of bag 34 to form ribs which act as ridges and grooves 38 on the inside of the bag, as shown in FIG. 8.

At the bottom of the inside of bag 34 (FIG. 1) is area 40 which is the lowest area in the bag and which is preferably formed with a rigid material, creating a rigid well. This low area houses a water evacuation device, preferably a conventional electric water sump pump 42 which has a flexible water evacuation hose 44 extending to the top side of bag 34 and over frame 22 or gate 26.

A conventional on/off electrical switch (not shown), controls the water pump and is located on frame 22 or dock 32 and has an electric wire leading to the pump. Ballast weights 46 are secured to the lower portions of bag 34 by suitable means, such as by placement inside pockets (not shown) sewn to the bag.

Operation—FIGS. 1, 2, 3, 5, 7, and 8

Figure 2:
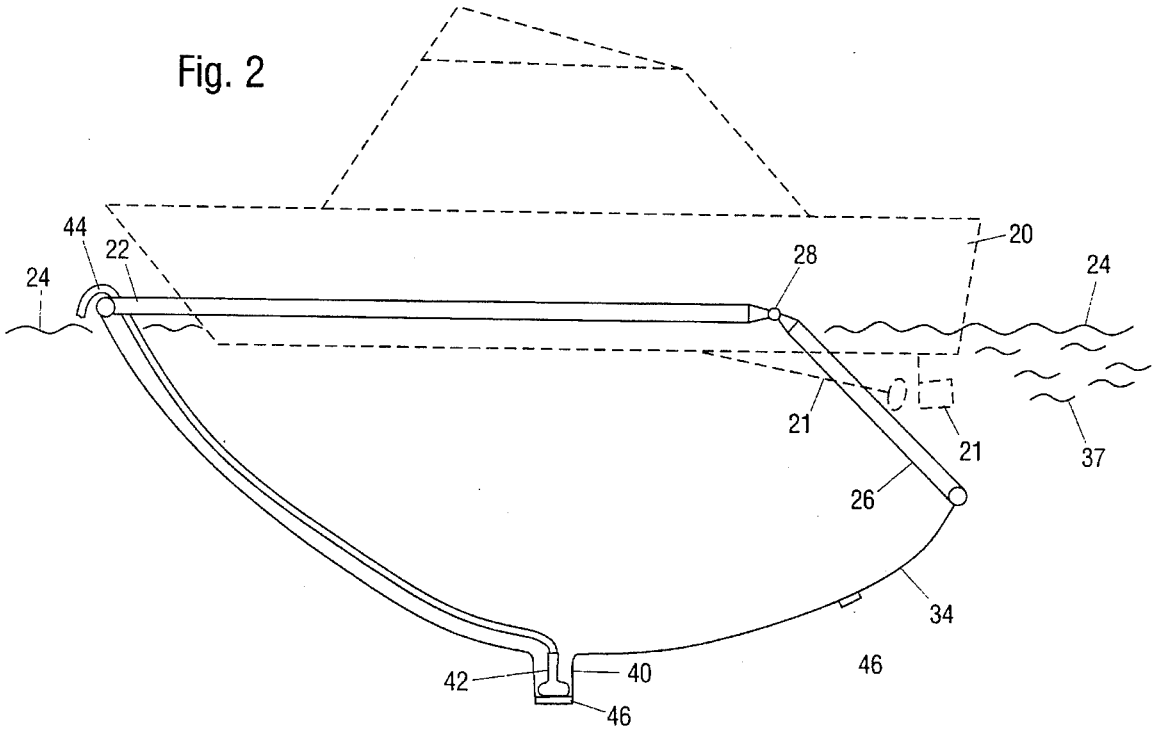
FIG. 2 is a side view of the enclosure of FIG. 1 with its rear gate lowered.
Figure 3:
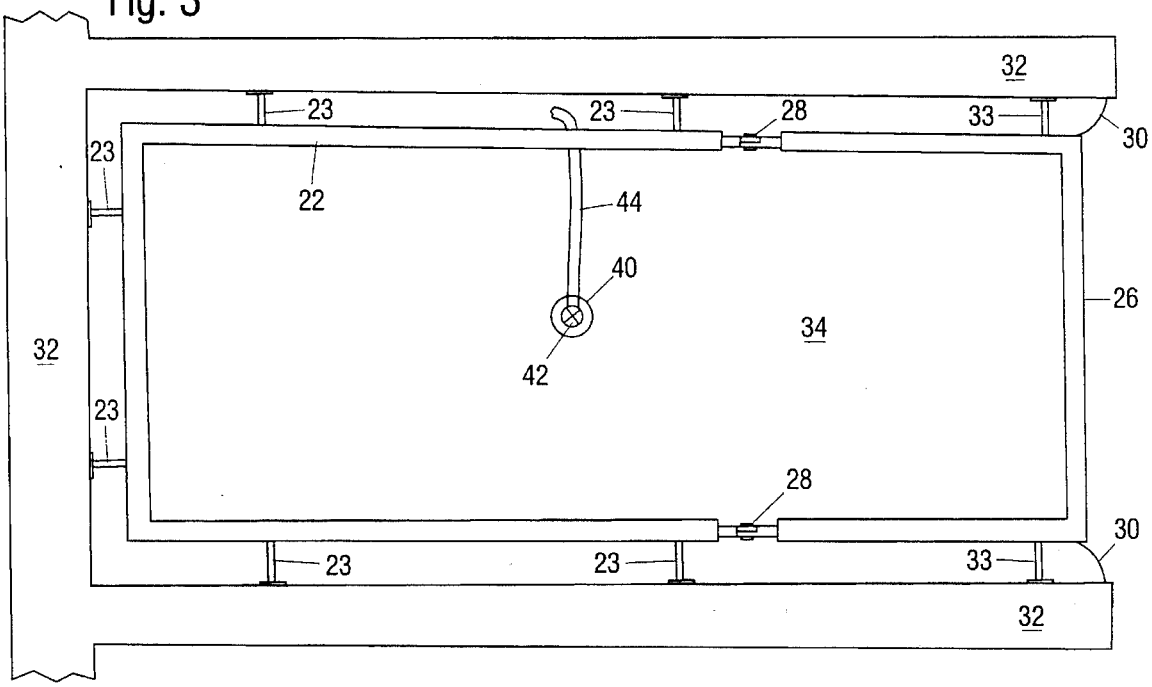
FIG. 3 is a top plan view of the enclosure of FIG. 1.

In use frame 22 (FIG. 3) is secured to a floating object, preferably dock 32, by frame support brackets 23. One end of each bracket is bolted to frame 22 and the other end is bolted to dock 32. The rear of frame 22 forms a gate 26 which is attached to the front portion of frame 22 by horizontal lag bolts 28 that serve as pivot pins. Gate lines 30 (FIG. 3) secured on one end to gate 26 and on the other end to cleats (not shown), secured to dock 32 are manually lowered thus lowering gate 26 below the waterline (FIG. 2). Then the boat is moved inside the enclosure and gate lines 30 are raised, thus raising gate 26 above the waterline (FIG. 1), and secured to cleats (not shown) on dock 32 or the boat. Additional suitable gate supports, such as pivotally swinging dock mounted gate support arms 33 (FIGS. 3 and 5) can be selectively positioned under gate 26 when gate 26 is in its raised position.

With gate 26 in its raised, closed position (FIG. 1), boat hull 20 will float inside frame 22 and it will be in water which is completely enveloped by bag 34. Bag 34 is secured to and dangles below frame 22 and gate 26. Hull 20 is thereby partitioned from main body of water 37.

Low area 40 which is at the bottom of the inside of bag 34 is preferably formed with a rigid material creating a rigid well which acts as a water collection reservoir. Inside low area 40 is electric sump pump 42 which is then activated by a switch (not shown) located on frame 22 or dock 32. Pump 42 will then pump out the water trapped inside bag 34 via hose 44. Hose 44 extends from pump 42 to the top side of bag 34 and over frame 22 or gate 26.

Protrusions 92 (FIG. 7) or ribs 38 (FIG. 8) on the inside of bag 34 form grooves or channels. These allow all water in bag 34 to drain to the lowest area of the bag. This reduces the possibility of water getting trapped in pockets which may otherwise form when the pressure of main body of water 37 (FIG. 1) presses bag 34 against hull 20 while the water in bag 34 is being removed.

When all water is evacuated from bag 34, boat hull 20 will be floating in water 37, but will be shielded by bag 34 from contact with water 37. Thus hull 20 is shielded from all the harmful effects that direct contact with water has on a boat hull and its driving gear.

When the boat leaves its mooring, gate 26 (FIG. 2) is lowered by swinging support arms 33 (FIGS. 3 and 5) away from gate 26 and lowering gate lines 30. Bag 34 will then become flooded as water enters bag 34 from water body 37 (FIG. 2). The water inside bag 34 will separate bag 34 from hull 20 by allowing bag 34 to sink below the hull, thus allowing the boat to leave its mooring. Ballast weights 46 (FIG. 1), attached to bag 34, will keep bag 34 away from boat hull 20 when bag 34 is flooded with water. These weights also help in maintaining a low area in bag 34.

Figure 11:
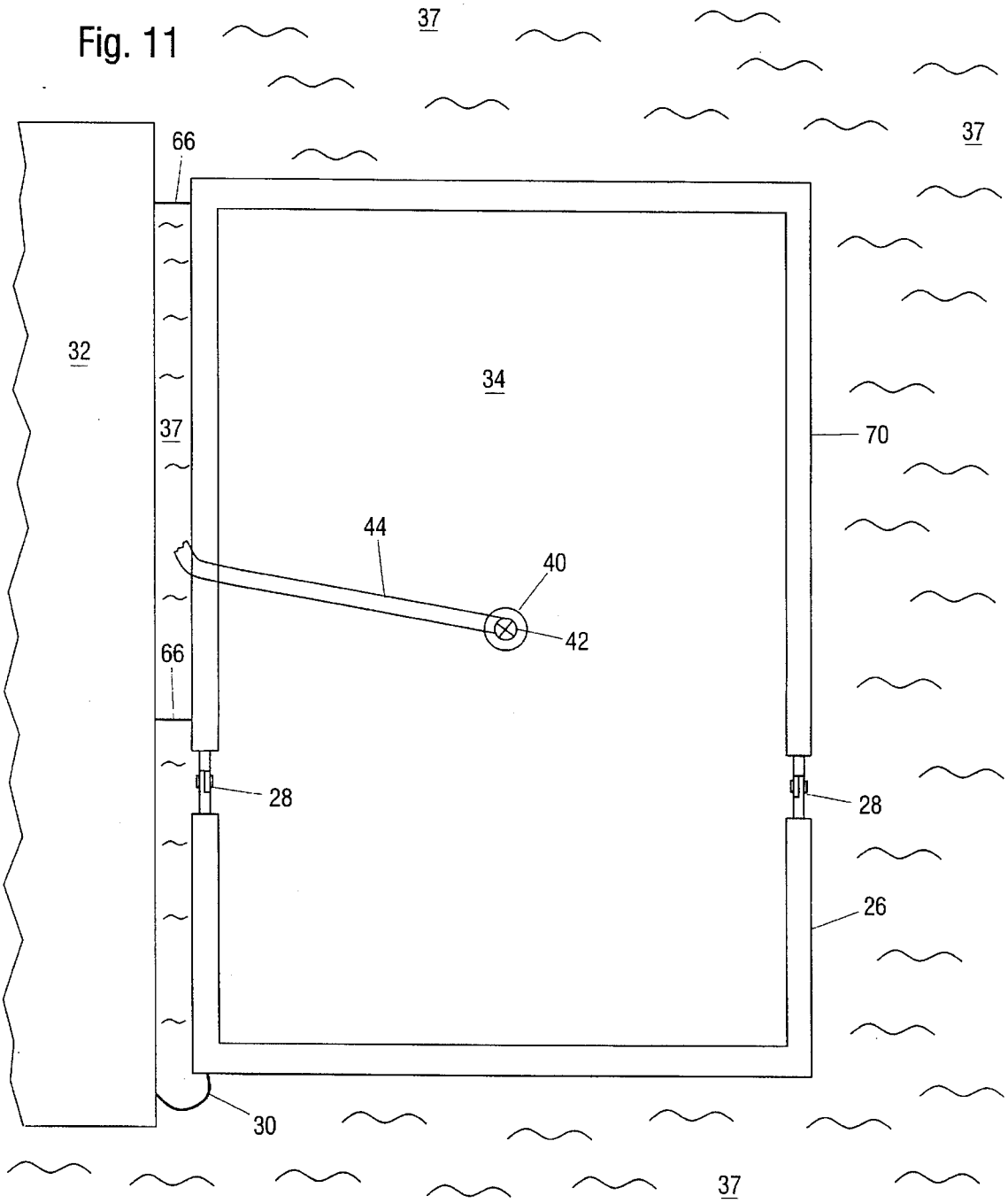
FIG. 11 is a top plan view of an alternative form of the enclosure which utilizes a frame containing buoyancy means, such as air or foam, and floats directly on water.

Frame Floats on Water—FIG. 11

As an alternative to securing the frame to a boat dock, frame 70, as shown in FIG. 11, contains buoyancy means, such as air or foam, and floats directly on water. In this example, the gate, which is not buoyant, is lowered and raised by gate lines. The entire device in this example is maintained in its position by lines 66 which are attached on one end to frame 70 and on the other end to mooring dock 32 or land.

Figure 12:
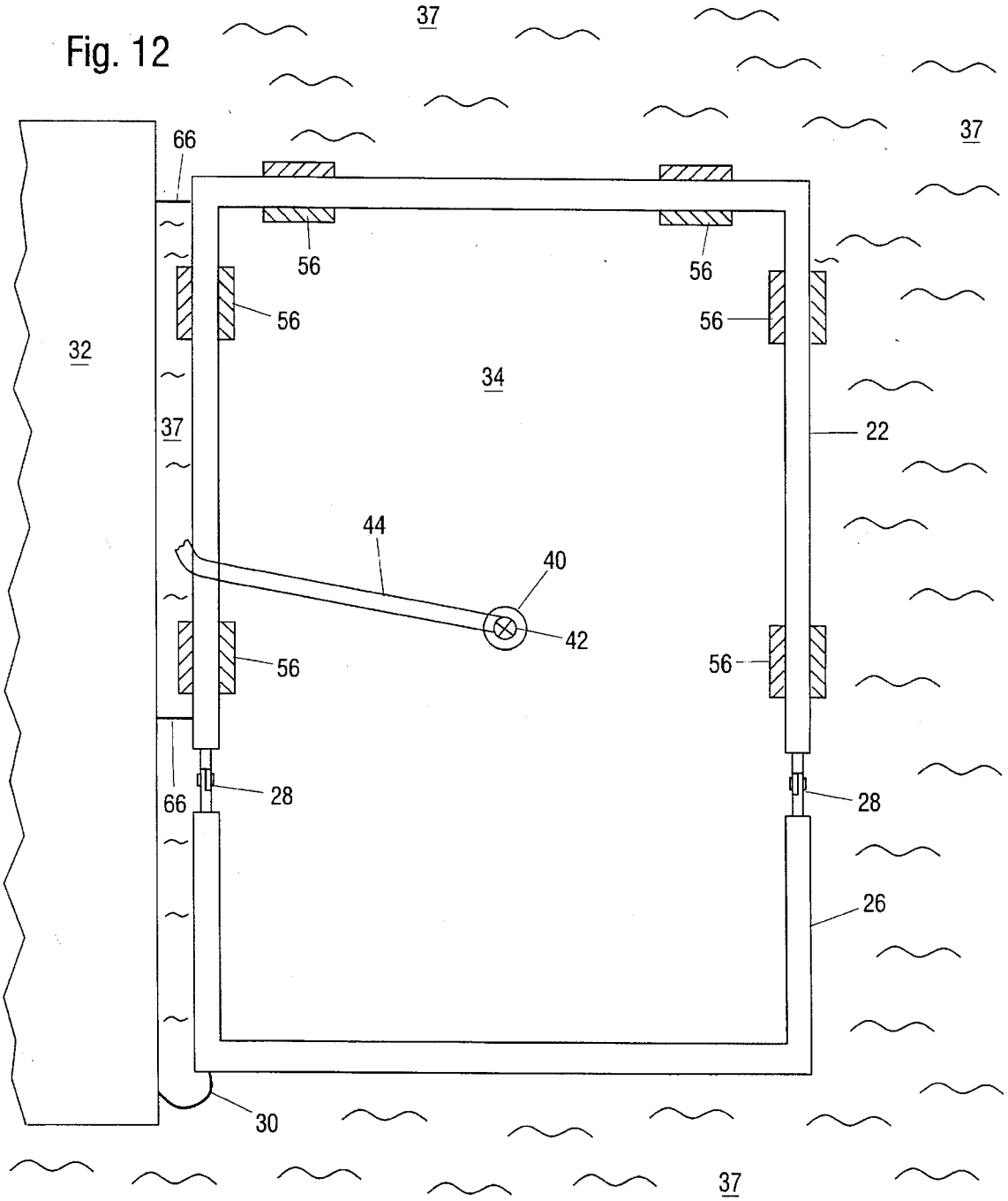
FIG. 12 is a top plan view of the enclosure floating on flotation devices.

Frame Floats on Flotation Devices—FIG. 12

As an alternative to securing the frame to a boat dock, frame 22, as shown in FIG. 12, is maintained above the water line by placing and securing suitable flotation devices, such as air-filled plastic containers 56, under frame 22. In this example the entire device is maintained in its position by lines 66 which are attached to frame 22 and mooring dock 32 or land.

Figure 13:
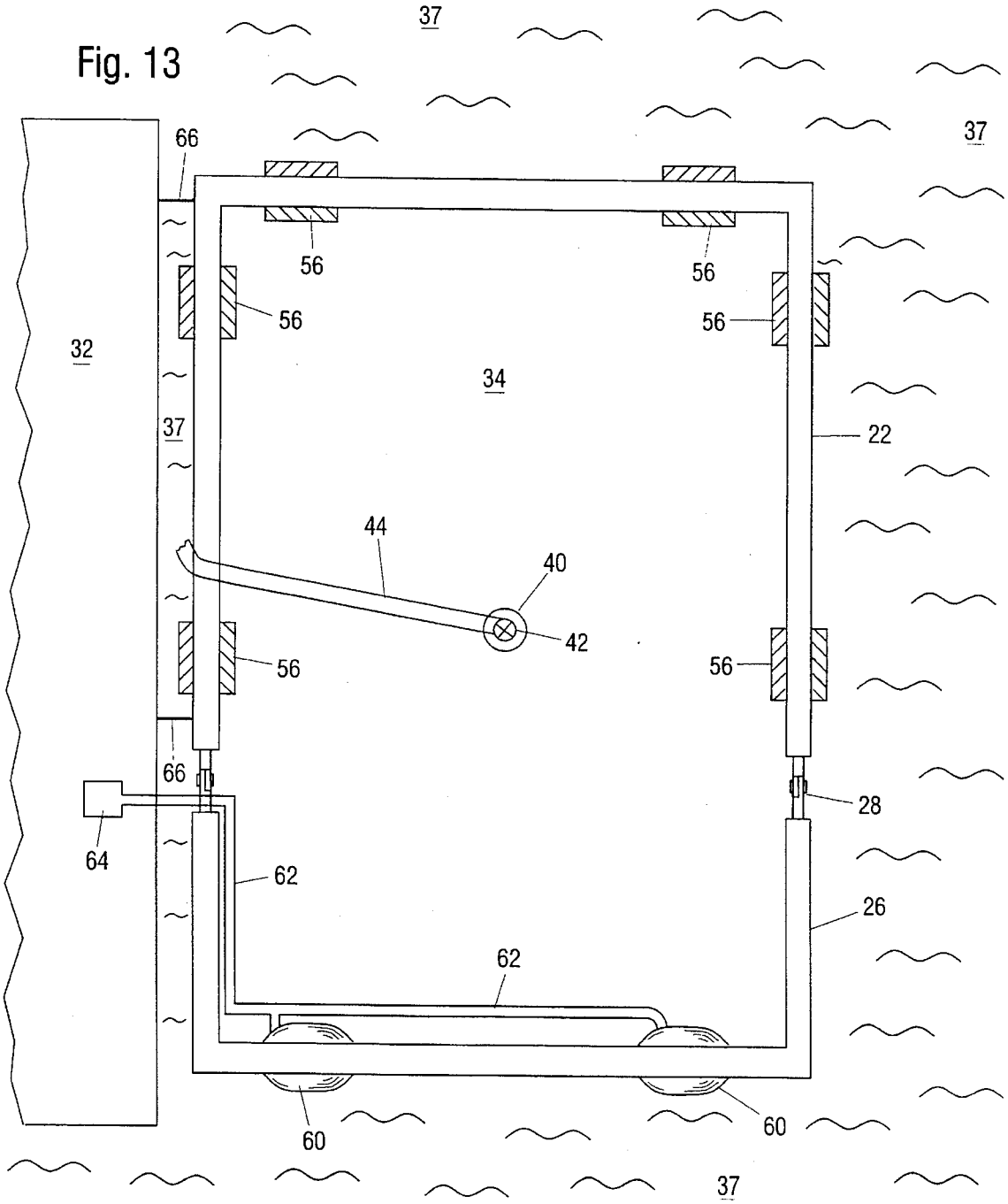
FIG. 13 is a top plan view of an alternative form of the enclosure which utilizes inflatable tubes placed under portions of the gate.

Gate Raised and Lowered Utilizing Inflatable Tubes—FIG. 13

As an alternative to raising and lowering gate 26 with gate lines, gate 26, as shown in FIG. 13, is raised and lowered by securing inflatable tubes 60 under gate 26. Inflatable tubes 60 are inflated by suitable means, such as a conventional air pump 64 which pumps air into air lines 62 which deliver air to inflatable tubes 60, thereby causing tubes 60 to float and raise gate 26. Tubes 60 can also be deflated, causing them to lose buoyancy so that gate 26 will be lowered. Flotation devices 56 are permanent floating objects, such as air filled plastic containers which maintain frame 22 above the water line. These permanent flotation devices can be eliminated if frame 22 is self-buoyant. In this example the entire device is maintained in its position by lines 66 which are attached to frame 22 and mooring dock 32 or land.

Figure 14:
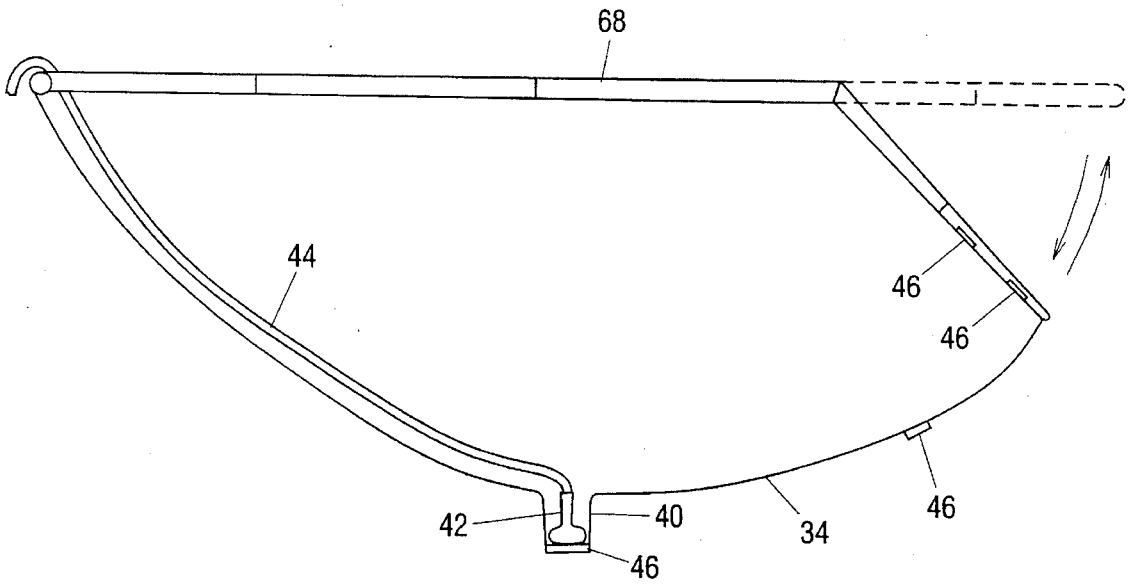
FIG. 14 is a side view of an alternative form of the enclosure utilizing an inflatable tube as the frame and gate.

Rigid Frame Replaced by Inflatable Tube—FIG. 14

As an alternative to having a rigid frame and a rigid gate, the rigid frame and gate can be replaced by inflatable tube 68, as shown in FIG. 14. Inflatable tube 68 acts as the frame and can be inflated sectionally, via an air pump (not shown). A gate on one or more sides of tube 68 can thus be created by selectively deflating a portion of tube 68, causing that portion of tube 68 to submerge while maintaining inflation in the other sections of tube 68. The gate section is raised by inflating that portion of tube 68 which acts as the gate. It should be noted that ballast weights 46 are secured to the portion of tube 68 which acts as the gate. In this example the entire device is maintained in its position by lines (not shown) which are attached to inflatable tube 68 and the mooring dock or boat (not shown).

Figure 4:
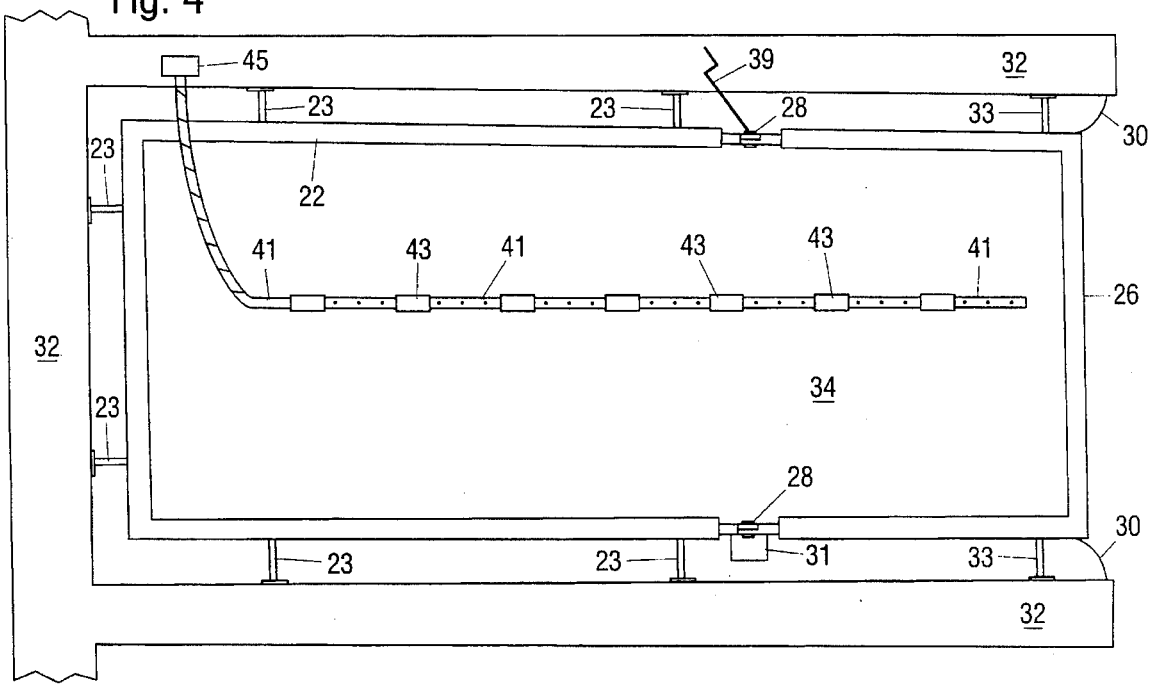
FIG. 4 is a top plan view of an alternative form of the enclosure using a perforated water suction hose.

Water Suction Evacuation Hose—FIG. 4

Low area 40 in bag 34 can be eliminated and replaced or supplemented by a water suction hose 41, as shown in FIG. 4. This hose is placed in the lower portions of bag 34 and is preferably secured to bag 34 by suitable means, such as being inserted inside sleeve 43, which comprises intermittent sections as shown, which are sewn inside bag 34. Hose 41 is preferably perforated in the area which lays at the lower portions of the bag with its suction end capped and extends to the exterior of bag 34 where it is connected to water pump 45, situated on dock 32 or on frame 22. When pump 45 is activated it will remove water out of bag 34 via suction hose 41. Alternatively, hose 41 can be connected to a water pump inside bag 34, similar to the attachment of hose 44 to pump 42 as shown in FIG. 1 and other Figures. The pump inside bag 34 is connected to a hose which is used to evacuate water out of bag 34 and which extends to the top of bag 34 and over frame 22 or gate 26. The purpose of hose 41 is to remove water from more than one area inside the bag. As shown, gate 26 can be operated by an electric gate motor 31 or a manual gear crank system 39.

CONCLUSIONS, RAMIFICATIONS AND SCOPE OF THE INVENTION

Thus the reader will see that the method and assembly of my enclosure for protecting a moored boat's hull is relatively inexpensive to produce, simple to install, simple to operate, environmentally safe, not water wasteful, reliable, adaptable to various types of water vessel hulls, can operate in deep water moorings, and will protect the below-the-water-line portion of a hull and driving gear of a water vessel from the damaging effects that these areas can experience if left in water for a period of time. These include significantly reducing marine growth on the hull and driving gear, protecting the vessel against electrolysis, water deterioration of the vessel's underwater hull fittings and submerged portions of the driving gear, fiberglass hull blistering, wood rot, and water leakage.

Various modifications and changes may be made in the enclosure as described without departing from the spirit of the present invention.

Figure 9:
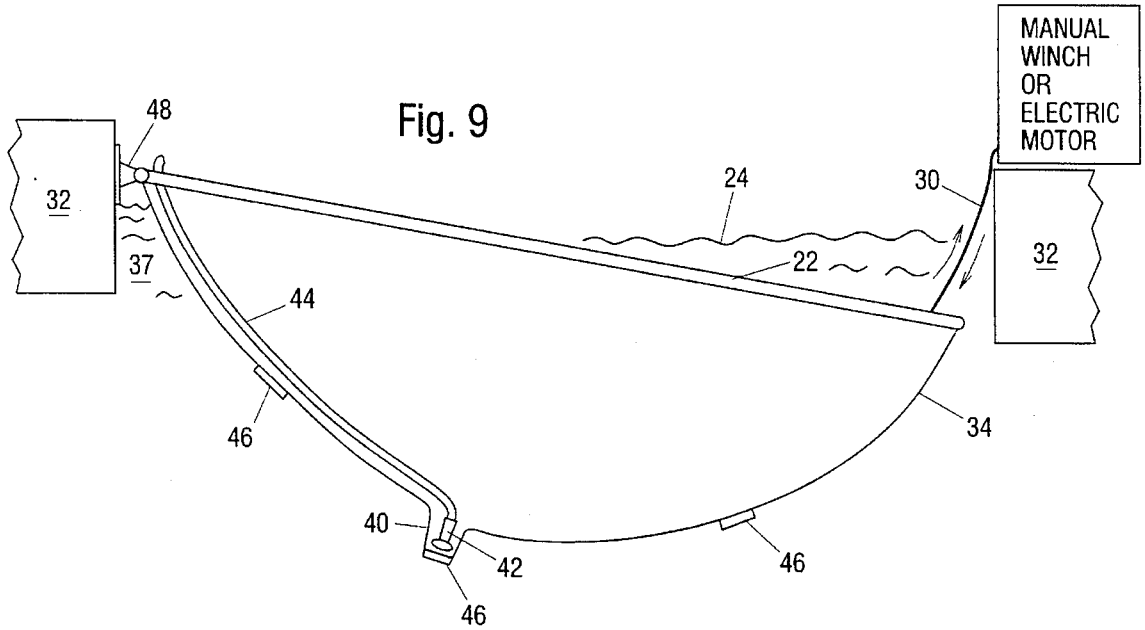
FIG. 9 is a side view of an alternative form of the enclosure which utilizes the entire frame as a gate.

By way of example, instead of frame 22 having a gate 26 which can be lowered or raised, the entire frame, as shown in FIG. 9, can pivot on one of its sides by suitable means, such as hinge brackets 48 secured on one end to dock 32 and on the other end to frame 22. The hinge brackets can also allow the frame to slide within the bracket from side to side so that if the water vessel inside the frame moves from side to side due to wave action in the main body of water, the frame will also move from side to side. Frame 22 can be raised or lowered by means of gate lines 30, which can be driven by a manual winch, an electric motor, or other appropriate means.

In another example, gate lines 30 can be lifted and lowered using a winch attached to the dock or boat (not shown), or gate 26 may be raised and lowered by means of an electric motor 31 (FIG. 4) or a manual gear crank system 39 (FIG. 4).

In another example, as an alternative to the previously described method of attaching bag 34 to frame 22 (FIG. 6), the upper peripheral portion 36 of bag 34 can be removably secured to frame 22 and gate 26 by lines which are tied to grommets (not shown) sewn into and around the upper peripheral portion 36 of bag 34 and tied around frame 22 and gate 26. Alternatively the upper peripheral portion 36 of bag 34 can be formed with sleeves (not shown) through which the rigid sections making up frame 22 and gate 26 are inserted.

In another example (not shown), the electric switch for water pump 42 can be connected to a conventional float switch located inside the bag or other automatic on/off devices. These devices will automatically activate the water pump when the bag contains water and deactivate the water pump when the bag is not holding water.

In another example (not shown), the entire frame of the apparatus can be lowered and raised uniformly into and out of the water guided by suitable means, such as guide rails secured to the sides of the boat dock and extending below the waterline.

Figure 10:
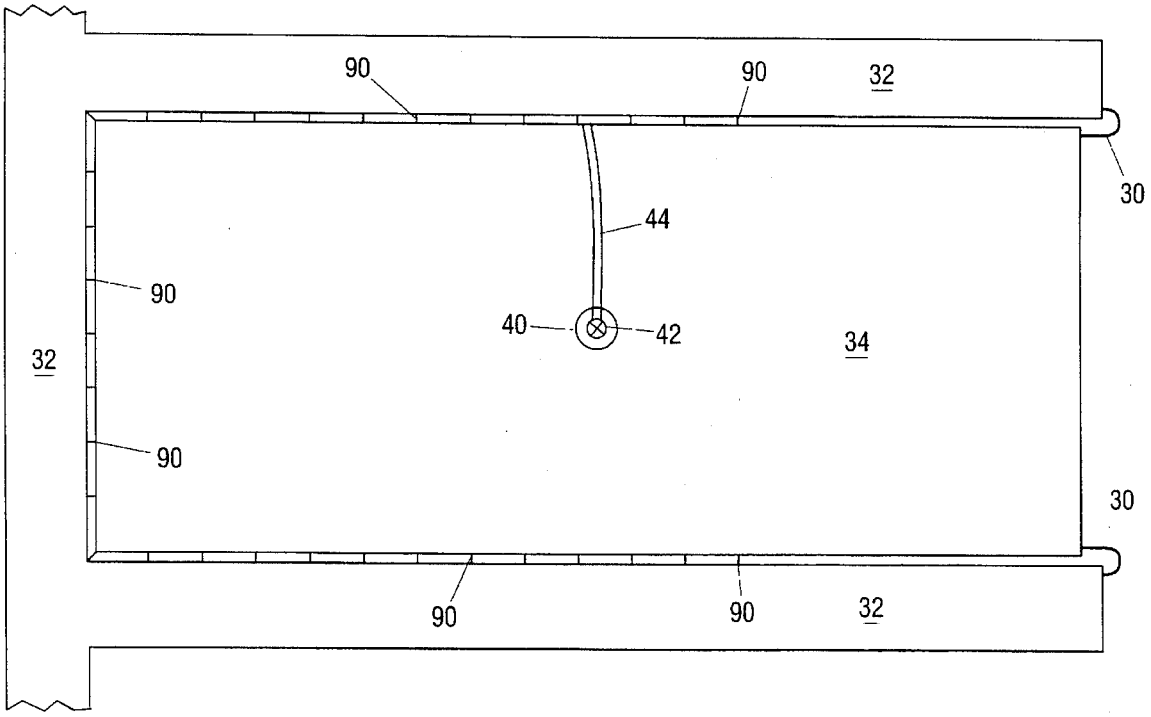
FIG. 10 is a top plan view of an alternative form of the enclosure which does not utilize a frame or rigid gate.

In another example shown in FIG. 10, the frame can be eliminated and the portion of bag 34 that is normally attached to the frame is attached directly or by suitable means, such as lines 90, to hooks or cleats (not shown) or other suitable means secured to dock 32. The pivot points of the rigid gate (not shown) are directly secured to dock 32 or the rigid gate (not shown) can be eliminated and gate lines 30 can instead be attached directly to the rear end of bag 34 which will itself act as the gate.

Accordingly, the scope of this invention should be determined by the appended claims and their legal equivalents, rather than by the examples given.

I claim:

1. A selectively submergible apparatus for enclosing and shielding the below-the-waterline portion of a moored water vessel's hull from direct contact with water, said vessel having predetermined waterline dimensions and predetermined below-the-waterline dimensions, comprising:

a frame having an inner opening greater in size than said predetermined waterline dimensions of said vessel, a water-impervious bag having greater inner dimensions than said predetermined below-the-waterline dimensions of said vessel, said bag being at least in part secured to said frame and dangling below said waterline, said bag having a lowest area which is lower than the rest of the bag so as to provide a water collection area when said bag is being drained of water, an attachment means attaching said frame to a solid object above said waterline, and an evacuation means for selectively evacuating water from inside said water-impervious bag, said evacuation means comprising a hose extending from said lowest area inside said bag and then up inside said bag and to outside said bag.

2. The apparatus of claim 1 wherein at least a portion of said frame is rigid.

3. The apparatus of claim 1 wherein said attachment means comprises a hinge.

4. The apparatus of claim 1 wherein said attachment means comprises a bracket which allows said frame to pivot on a horizontal axis.

5. The apparatus of claim 1 wherein said attachment means comprises at least one line having one end secured to said frame and an opposite end secured to said solid object.

6. The apparatus of claim 1, further including an elevation means for submerging and raising at least a portion of said frame.

7. The apparatus of claim 6 wherein said elevation means comprises at least one line, one end of said line being attached to said frame, the other end of said line attached to a solid object above said waterline so that a person or mechanical device can raise or lower said line.

8. The apparatus of claim 6 wherein said elevation means comprise a gear crank coupled to said frame so that a portion of said frame can be selectively raised or lowered by turning said gear crank.

9. The apparatus of claim 6 wherein said elevation means comprises a motor coupled to said frame so that said frame can be selectively raised or lowered by operating said motor.

10. The apparatus of claim 6 wherein said elevation means comprise inflatable means coupled to said frame so that a portion of said frame can be selectively raised or lowered by selectively inflating or deflating said inflatable means.

11. The apparatus of claim 1 wherein said lowest area is made of a rigid material.

12. The apparatus of claim 1 wherein said evacuation means also comprises a water pump located inside said bag and attached to said hose.

13. The apparatus of claim 1, further including at least one ballast weight secured to said bag.

14. The apparatus of claim 1, further including a swinging support arm secured to a fixed object above said waterline for supporting said frame above said waterline.

15. The apparatus of claim 1, further including a plurality of spaced protrusions on an inside surface of said bag, said protrusions forming grooves which act as water channels to permit water to flow to said lowest area of said bag when said bag is being drained of water and is pressed against said vessel's hull.

16. The apparatus of claim 1 wherein said frame is elongated and has opposite end portions, one end portion being hingedly attached to the rest of said frame so that said one end portion can pivot downwardly with respect to the rest of said frame, such that lowering said one end portion will allow said vessel to sail in and out of said frame.

17. The apparatus of claim 16 wherein all of said frame, except said one end portion, contains buoyant means so that said frame will float on water.

18. The apparatus of claim 1 wherein said evacuation means comprises a water pump located outside said bag, said water pump having a suction end and connected to said hose.

19. The apparatus of claim 18 wherein at least a portion of said hose is perforated.

20. The apparatus of claim 1, further including a plurality of sleeves attached to said bag.

21. A selectively submergible apparatus for enclosing and shielding the below-the-waterline portion of a moored water vessel's hull from direct contact with water, said vessel having predetermined waterline dimensions and predetermined below-the-waterline dimensions, comprising:

a frame having an inner opening greater in size than said waterline dimensions of said vessel, a water-impervious bag having greater inner dimensions than said predetermined below-the-waterline dimensions of said vessel, at least a part of said bag being secured to said frame so that said bag dangles below said frame, said bag having a lowest area which is lower than the rest of the bag so as to provide a water collection area when said bag is being drained of water, an elevation means for submerging and raising at least a portion of said frame above said waterline, and an evacuation means for selectively evacuating water from inside said water-impervious bag, said evacuation means comprising a hose extending from said lowest area inside said bag and then up inside said bag and past said frame to outside said bag.

22. The apparatus of claim 21 wherein at least a part of said frame is rigid.

23. The apparatus of claim 21, further including attachment means for attaching said frame to a solid object above said waterline.

24. The apparatus of claim 23 wherein said attachment means comprises a bracket.

25. The apparatus of claim 23 wherein said attachment means comprises a hinge which allows said frame to pivot vertically.

26. The apparatus of claim 23 wherein said attachment means comprises at least one line secured on one end to said frame and secured on the other end to said solid object above said waterline.

27. The apparatus of claim 21 wherein said elevation means comprises at least one line, one end of said line being attached to said frame, the other end of said line attached to a solid object above said waterline so that a person or mechanical device can raise or lower said line.

28. The apparatus of claim 21 wherein said elevation means comprises a gear crank coupled to said frame so that a portion of said frame can be selectively raised or lowered by turning said gear crank.

29. The apparatus of claim 21 wherein said elevation means comprises a motor coupled to said frame so that said frame can be selectively raised or lowered by operating said motor.

30. The apparatus of claim 21 wherein said elevation means comprises inflatable means coupled to said frame so that a portion of said frame can be selectively raised or lowered by selectively inflating or deflating said inflatable means.

31. The apparatus of claim 21 wherein said evacuation means also comprises a water pump located inside said bag and attached to said hose.

32. The apparatus of claim 21, further including at least one ballast weight secured to said bag.

33. The apparatus of claim 21, further including a swinging support arm secured to a fixed object above said waterline for supporting said frame when it is raised above said waterline.

34. The apparatus of claim 21, further including a plurality of spaced protrusions on an inside surface of said bag, said protrusions forming grooves which act as water channels to permit water to flow to said lowest area of said bag when said bag is being drained of water and is pressed against said vessel's hull.

35. The apparatus of claim 21 wherein said frame is elongated and has opposite end portions, one end portion being hingedly attached to the rest of said frame so that said one end portion can pivot downwardly with respect to the rest of said frame, such that lowering said one end portion will allow said vessel to sail in and out of said frame.

36. The apparatus of claim 34 wherein all of said frame, except said one end portion contains buoyancy means so that said frame will float on water.

37. The apparatus of claim 21 wherein said evacuation means comprises a water pump located outside said bag, said water pump having a suction end connected to said hose.

38. The apparatus of claim 37 wherein at least a portion of said hose is perforated.

39. The apparatus of claim 21, further including a plurality of sleeves attached to said bag.

40. Apparatus for shielding a moored water vessel's hull and said vessel's driving gear from direct contact with water, comprising:

a water-impervious bag having greater inner dimensions than the below-the-waterline dimensions of said water vessel, said bag being positioned around the perimeter of said water vessel and attached to and dangling below a solid object which is above the waterline of said vessel, said bag having a lowest area which is lower than the rest of the bag so as to provide a water collection area when said bag is being drained of water, and an evacuation means for selectively evacuating water from inside said water-impervious bag, said evacuation means comprising a hose extending from said lowest area inside said bag and then up inside said bag to outside said bag.

41. The apparatus of claim 39, further including a U-shaped frame attached to said solid object above said waterline, a portion of said bag being attached to said U-shaped frame.

42. The apparatus of claim 41 wherein said U-shaped frame is attached to said solid object by pivot means which allows said U-shaped frame to pivot on a horizontal axis.

43. The apparatus of claim 40, further including a plurality of lines, one end of each of said lines being attached to said bag, the other end of each of said lines being attached to a solid object above said waterline, so that said bag can be partially submerged into and raised out of the water by a person or mechanical device raising and lowering said lines.

44. The apparatus of claim 40 wherein said lowest area is made of a rigid material.

45. The apparatus of claim 40 wherein said evacuation means also comprises a water pump located inside said bag and attached to said hose.

46. The apparatus of claim 40, further including at least one ballast weight secured to said bag.

47. The apparatus of claim 40, further including a plurality of spaced protrusions on an inside surface of said bag, said protrusions forming grooves which act as water channels to permit water to flow to said lowest area of said bag when said bag is being drained of water and is pressed against said vessel's hull.

48. The apparatus of claim 40 wherein said bag is heavier than water and includes inflatable means attached to said bag so that said bag can be selectively raised or lowered by selectively inflating or deflating said inflatable means.

49. The apparatus of claim 40 wherein said evacuation means comprises a water pump located outside said bag and having a suction end connected to said hose.

50. The apparatus of claim 40 wherein at least a portion of said hose is perforated.

51. The apparatus of claim 40, further including a plurality of sleeves attached to said bag.

52. A selectively submergible apparatus for enclosing and shielding the below-the-waterline portion of a moored water vessel from direct contact with water, comprising:

a sectionally inflatable frame having an inner opening greater in size than the perimeter of said water vessel hull at the waterline, a water-impervious bag having greater inner dimensions than the dimensions of said water vessel below said waterline, said bag being secured to and dangling below said sectionally inflatable frame, said bag having a lowest area which is lower than the rest of the bag so as to provide a water collection area when said bag is being drained of water, and an evacuation means for selectively evacuating water from inside said water-impervious bag, said evacuation means comprising a hose extending from said lowest area inside said bag and then up inside said bag and past said frame to outside said bag.

53. The apparatus of claim 52, further including means for submerging and raising said sectionally inflatable frame above water by deflating or inflating said sectionally inflatable frame.

54. The apparatus of claim 52, further including a plurality of lines securing said sectionally inflatable frame to a solid object above said waterline.

55. The apparatus of claim 52 wherein said evacuation means comprises a water pump located outside said bag and having a suction end connected to said hose.

56. The apparatus of claim 55 wherein at least a portion of said hose is perforated.

57. The apparatus of claim 52 wherein said lowest area is made of a rigid material.

58. The apparatus of claim 52 wherein said evacuation means also comprises a water pump located inside said bag and attached to said hose.

59. The apparatus of claim 52, further including at least one ballast weight secured to said bag.

60. The apparatus of claim 52, further including a plurality of spaced protrusions on an inside surface of said bag, said protrusions forming grooves which act as water channels to permit water to flow to said lowest area of said bag when said bag is being drained of water and is pressed against said vessel's hull.

61. The apparatus of claim 52, further including a plurality of sleeves attached to said bag.

62. A selectively submergible apparatus for enclosing and shielding the below-the-waterline portion of a moored water vessel from direct contact with water, said vessel having a hull with predetermined waterline dimensions and predetermined below-the-waterline dimensions, comprising:

a water-impervious bag having greater inner dimensions than the below-the-waterline dimensions of said water vessel, said bag being attached to a solid object above the waterline of said water vessel and positioned around the perimeter of said water vessel, said bag having a plurality of spaced protrusions on an inside surface of said bag, said protrusions forming grooves which act as water channels to permit water to flow to a lowest area of said bag when said bag is being drained of water and is pressed against said water vessel's hull, an evacuation means for selectively evacuating water from inside said water-impervious bag, and a means for submerging and raising said bag above said waterline.

* * * * *